US006701898B2

(12) United States Patent
Tokuo et al.

(10) Patent No.: US 6,701,898 B2
(45) Date of Patent: Mar. 9, 2004

(54) FUEL SUPPLY APPARATUS AND METHOD OF CONTROL THEREOF

(75) Inventors: Kenichiro Tokuo, Chiyoda (JP); Kenji Hiraku, Chiyoda (JP); Tadahiko Nogami, Mito (JP); Kunihiko Takao, Tsuchiura (JP); Hiroyuki Yamada, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/930,945

(22) Filed: Aug. 17, 2001

(65) Prior Publication Data

US 2002/0129793 A1 Sep. 19, 2002

(30) Foreign Application Priority Data

Mar. 15, 2001 (JP) ..... 2001-073280

(51) Int. Cl.[7] ..... F02M 37/04
(52) U.S. Cl. ..... 123/456; 123/506
(58) Field of Search ..... 123/456, 446, 123/506, 458, 198 F, 21

(56) References Cited

U.S. PATENT DOCUMENTS

| | | | | | |
|---|---|---|---|---|---|
| 4,478,187 | A | * | 10/1984 | Yamada | 123/449 |
| 4,489,684 | A | * | 12/1984 | Yamada | 123/198 F |
| 5,277,156 | A | * | 1/1994 | Osuka et al. | 123/456 |
| 5,404,855 | A | * | 4/1995 | Yen et al. | 123/446 |
| 6,065,436 | A | * | 5/2000 | Koga et al. | 123/179.17 |
| 6,095,118 | A | * | 8/2000 | Klinger et al. | 123/456 |
| 6,131,548 | A | * | 10/2000 | Yano | 123/456 |
| 6,192,864 | B1 | * | 2/2001 | Nishimura | 123/458 |
| 6,257,204 | B1 | * | 7/2001 | Kamijo et al. | 123/456 |

* cited by examiner

*Primary Examiner*—Carl S. Miller
(74) *Attorney, Agent, or Firm*—Antonelli, Terry, Stout & Kraus, LLP

(57) ABSTRACT

In a fuel supply apparatus disclosed, a variable displacement mechanism is driven once every two or more reciprocating motions of the plunger of a high-pressure fuel pump to control the delivery flow rate, so that the delivery flow rate control can be performed without having to raise the responsiveness of the variable displacement mechanism even when the reciprocating cycle of the plunger is short.

14 Claims, 6 Drawing Sheets

RETRACTION DELAY TIME $t_1$

PULL-DOWN DELAY TIME $t_2$

RETRACTION DELAY TIME $t_1$

PULL-DOWN DELAY TIME $t_2$

CLOSE DELAY TIME $t_1'$

OPEN DELAY TIME $t_2'$

CLOSE DELAY TIME $t_1'$

OPEN DELAY TIME $t_2'$

FUEL SUPPLY APPARATUS AND METHOD OF CONTROL THEREOF

BACKGROUND OF THE INVENTION

The present invention relates to a fuel supply apparatus for in-cylinder injection engines, and more particularly to a delivery flow rate control method.

One conventional fuel supply apparatus is known to perform the delivery flow rate control by giving a drive signal to an actuator for every delivery stroke and controlling a drive signal application timing, as described in, for instance, International Publication No. WO 00/47888.

The conventional high-pressure fuel pump described above, however, has a problem that there is a time lag from applying the drive signal to driving the actuator and, when a reciprocating cycle of a plunger is short, the operation of the actuator cannot keep up with the reciprocating action of the plunger.

In actual automobiles, such a situation can occur when the engine revolution speed is high. In apparatus that supply fuel to engines of large displacements, a similar situation also occurs when the number of reciprocations of the plunger during each rotation of a cam, i.e., the number of lobes of the drive cam, is increased to increase the delivery flow from the high-pressure fuel pump for every one revolution of the cam.

SUMMARY OF THE INVENTION

An object of the present invention is to provide a fuel supply apparatus for variable displacement, high-pressure fuel pumps, which enables a delivery flow rate control even when a reciprocating cycle of a plunger is short, without having to increase the responsiveness of an actuator, or a variable displacement mechanism.

The above object can be achieved by a fuel supply apparatus which comprises a high-pressure fuel pump of a single-cylinder plunger type having a variable displacement mechanism, the variable displacement mechanism supplying fuel under pressure to fuel injection valves, and a controller for controlling the variable displacement mechanism of the high-pressure fuel pump to regulate a fuel supply pressure, wherein the variable displacement mechanism is driven once at every two or more reciprocating motions of the plunger of the high-pressure fuel pump.

The above object is also achieved by the fuel supply apparatus wherein the pump does not deliver fuel in one of every two reciprocating motions thereof and controls a delivery flow in the other reciprocating motion.

The above object is also achieved by the fuel supply apparatus wherein the pump delivers all the volume of fuel displaced by the plunger in one of every two reciprocating motions thereof.

The above object is also achieved by the fuel supply apparatus wherein the controller calculates a necessary amount of fuel to be supplied to the fuel injection valves such that (i) when the amount of fuel to be supplied is nearly 50% or less of the maximum delivery flow rate of the high-pressure fuel pump, the pump does not deliver fuel in one of every two reciprocating motions thereof and controls a delivery flow in the other reciprocating motion, and (ii) when the amount of fuel to be supplied is nearly 50% or more of the maximum delivery flow rate of the high-pressure fuel pump, the pump delivers all the volume of fuel displaced by the plunger in one of every two reciprocating motions thereof and controls a delivery flow rate in the other reciprocating motion.

The above object is also achieved by a method of controlling a fuel supply apparatus, the fuel supply apparatus comprising a high-pressure fuel pump of a single-cylinder plunger type having a variable displacement mechanism, the variable displacement mechanism supplying fuel under pressure to fuel injection valves, a controller for controlling the variable displacement mechanism of the high-pressure fuel pump to regulate a fuel supply pressure at an almost constant value, and an actuator forming the variable displacement mechanism and effecting drive responsiveness to a drive signal given from the controller, wherein the variable displacement mechanism performs a variable displacement operation by changing its own position, and the controller, after having shut off the drive signal to the variable displacement mechanism, reduces the number of times of driving the variable displacement mechanism as compared with the number of reciprocating motions of the plunger so that the controller will not send the next drive signal at least until the variable displacement mechanism returns to its initial position.

The above object is also achieved by a method of controlling a fuel supply apparatus, the fuel supply apparatus comprising a high-pressure fuel pump of a single-cylinder plunger type having a variable displacement mechanism, the variable displacement mechanism supplying fuel under pressure to fuel injection valves, and a controller for controlling the variable displacement mechanism of the high-pressure fuel pump to regulate a fuel supply pressure at an almost constant value, wherein the high-pressure fuel pump has a suction valve automatically opening irrespective of the operation of the variable displacement mechanism, and the controller calculates a necessary amount of fuel to be supplied to the fuel injection valves such that (i) when the amount of fuel to be supplied is nearly 50% or less of a maximum delivery flow rate of the high-pressure fuel pump, the variable displacement mechanism is drive once so that the plunger does not deliver fuel in one of every two reciprocating motions thereof and controls a delivery flow in the other reciprocating motion, and (ii) when the amount of fuel to be supplied is nearly 50% or more of the maximum delivery flow rate of the high-pressure fuel pump, the variable displacement mechanism is driven once so that the plunger delivers all the volume of fuel displaced by the plunger in one of every two reciprocating motions thereof and controls a delivery flow rate in the other reciprocating motion.

DESCRIPTION OF PREFERRED EMBODIMENTS

Now, embodiments of the present invention will be described with reference to the accompanying drawings.

Figure 1:
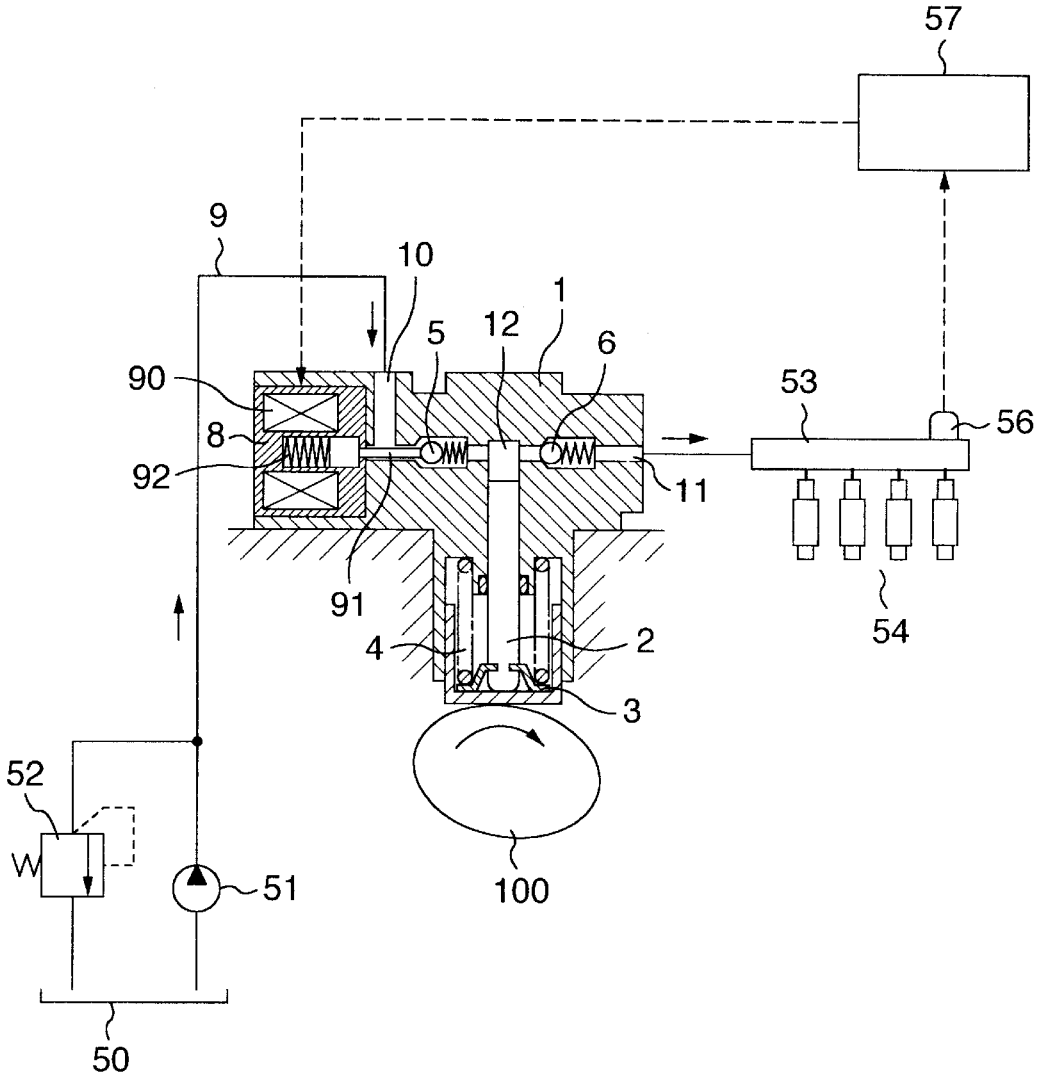
FIG. 1 is a schematic diagram showing a construction of a high-pressure fuel pump incorporating one embodiment of the present invention.

FIG. 1 illustrates an outline of a fuel supply system using a high-pressure fuel pump incorporating an embodiment of the invention.

In FIG. 1, a pump body 1 is formed with a fuel suction passage 10, a delivery passage 11 and a pressurizing chamber 12. In the pressurizing chamber 12, a plunger 2 which forms a pressurizing member is slidably installed. In the fuel suction passage 10 and the delivery passage 11 are installed a suction valve 5 and a delivery valve 6, respectively, which are each urged in one direction by a spring to serve as a check valve to limit the direction in which the fuel can flow. An actuator 8 is held in the pump body 1 and comprises a solenoid 90, a rod 91 and a spring 92. The rod 91 is urged by the spring 92 in a direction that opens the suction valve 5 when the actuator 8 is not given a drive signal. Because the force of the spring 92 is set larger than the force of the spring of the suction valve 5, the suction valve 5 is open as shown in FIG. 1 when the drive signal is not applied to the actuator 8.

Fuel is supplied from a tank 50 to a fuel delivery port of the pump body 1 by a low-pressure pump 51 while at the same time being regulated at a constant pressure by a pressure regulator 52. The fuel is then pressurized by the pump body 1 and delivered under pressure from a fuel delivery port to a common rail 53. The common rail 53 has injectors 54 and a pressure sensor 56 installed thereto. The injectors 54 match in number the cylinders in the engine and inject fuel according to signals from a controller 57.

The plunger 2 is reciprocated by a cam 100 rotated by an engine camshaft to change the volume of the pressurizing chamber 12.

As the suction valve 5 closes during the delivery stroke of the plunger 2, the pressure in the pressurizing chamber 12 increases causing the delivery valve 6 to automatically open to deliver fuel under pressure to the common rail 53.

When the pressure in the pressurizing chamber 12 drops below the fuel introducing port, the suction valve 5 automatically opens. The closure of the suction valve 5 is determined by the operation of the actuator 8.

When the actuator 8 is given a drive signal and held, the solenoid 90 produces an electromagnetic force larger than the urging force of the spring 92, attracting the rod 91 toward the solenoid 90, with the result that the rod 91 parts from the suction valve 5. In this state, the suction valve 5 works as a normal check valve that automatically opens and closes in synchronism with the reciprocating motion of the plunger 2. Hence, in the delivery stroke, the suction valve 5 closes and the amount of fuel equal to a volume by which the pressurizing chamber 12 is compressed pushes open the delivery valve 6 and is delivered under pressure to the common rail 53. The pump delivery flow rate therefore is largest.

If, on the other hand, the actuator 8 is not given a drive signal, the urging force of the spring 92 causes the rod 91 to push open the suction valve 5 and holds it open. Hence, the pressure in the pressurizing chamber 12 remains at a low pressure almost equal to that of the fuel introducing port even during the delivery stroke, so that the delivery valve 6 cannot be opened. The quantity of fuel equal to a volume by which the pressurizing chamber 12 is compressed is therefore returned through the suction valve 5 to the fuel delivery port side. The pump delivery flow rate therefore becomes zero.

During the delivery stroke, when a drive signal is applied to the actuator 8, the fuel is delivered under pressure to the common rail 53 with a response delay of the actuator 8. Once the fuel delivery has begun, the pressure in the pressurizing chamber 12 increases keeping the suction valve 5 closed even after the drive signal to the actuator 8 is cut off. After this, the suction valve 5 automatically opens in synchronism with the begining of the suction stroke of the plunger 2. Therefore, in the delivery stroke the timing of applying a drive signal to the actuator 8 can adjust the delivery flow in a variable range of between zero and the maximum delivery flow. A ratio of the delivery flow to the maximum delivery flow, averaged over time, is called a duty hereinafter.

Based on a signal from the pressure sensor 56, the controller 57 calculates an appropriate delivery timing and controls the rod 91 to keep the pressure in the common rail 53 at an almost constant value.

Next, an example in which the actuator 8 of a high-pressure fuel pump is driven by the control method of the invention will be described with reference to FIG. 2 and FIG. 3.

Figure 2:
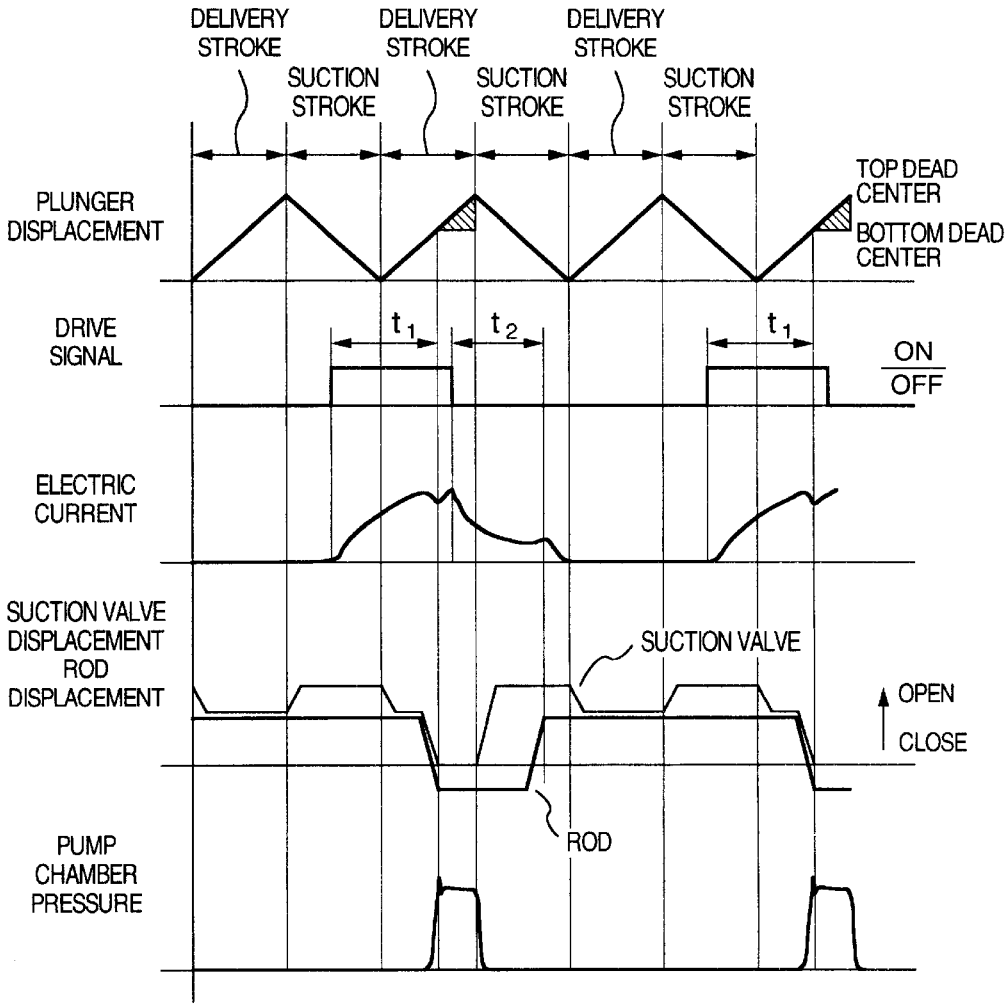
FIG. 2 is a timing diagram showing an example control of the high-pressure fuel pump of the present invention.

FIG. 2 illustrates an embodiment of a control timing when the high-pressure fuel pump is operated at a duty of 50% or less. This operating condition is required when the engine load is small, for example, during cruising, deceleration and idling of an automobile.

In other words, in this operating condition, the engine requires almost no extra output torques and fuel consumption is small. The delivery flow rate control in this case is performed by applying a drive signal to the actuator 8 once every two reciprocating motions of the plunger 2. In one out of every two delivery strokes the fuel is not delivered and the delivery flow in the remaining delivery stroke is controlled to control the average delivery flow in the two compression strokes. In the delivery stroke that controls the delivery flow, a drive signal is applied to the actuator 8 at a timing advanced from a target delivery start timing by a time interval equal to the response delay of the actuator 8. This retracts the rod 91 to allow the suction valve 5 to close so that the fuel can be compressed and delivered at the target delivery start timing. The delivery flow produced by the two compression strokes is equal to the delivery flow of this one compression stroke. The timing and duration at which the drive signal is applied to the actuator 8 is calculated by the controller 57.

When a drive signal is applied to the actuator 8, the solenoid 90 is energized and the current passing through the solenoid 90 rises with a time delay of first order caused by an inductance of the solenoid. The time which elapses after a drive signal is applied to the actuator until the current through the solenoid 90 rises high enough so that the electromagnetic force of the solenoid 90 can retract the rod 91 is the response delay time of the actuator 8 when driven. This length of time is hereinafter called a retraction delay time t1. When the drive signal is cut off, a certain period of time elapses before the current through the solenoid 90 falls below a limit current for holding the rod 91 due to the inductance of the solenoid 90. The time that passes from the drive signal being cut off to the rod 91 falling down is hereinafter called a pull-down delay time t2.

When, for example, a desired duty of the high-pressure fuel pump is 25%, a time-averaged duty of 25% is obtained by delivering in one of every two delivery strokes 0% of the volume that is displaced by the plunger 2 and delivering 50% of the volume displaced by the plunger 2 in the other delivery stroke. During the delivery stroke, the controller 57 sends a drive signal to the actuator 8 at a timing advanced by the retraction delay time t1 from the timing at which the plunger will finish the 50% delivery stroke. Then, the controller 57 cuts off the drive signal so that the rod 91 returns before the next delivery stroke begins.

The advantage of controlling the delivery flow rate in this manner is that because the actuator is not driven every time the plunger 2 reciprocates, the interval between the drive signals increases. With the conventional control methods, the actuator cannot control the delivery flow rate unless the sum of the retraction delay time t1 and the pull-down delay time t2 is shorter than at least the reciprocating cycle of the plunger. The control according to this embodiment, however, can control the delivery flow rate even when the reciprocating cycle of the plunger is short. Hence, the response speed of the actuator of the fuel supply apparatus need not be raised, making it possible to supply a required amount of fuel to an engine running at high speed. Further, because the number of times that the actuator 8 is energized decreases, the power consumption and the amount of heat generated are also reduced.

Further, if the cam 100 that drives the plunger 2 has an increased number of lobes, for example four or five lobes, rather than two as in the case of FIG. 1, this control method can also be used. The time an increased number of cam lobes are used is when supplying a large amount of fuel to an engine or when supplying fuel to an engine with a large displacement or an engine with a turbocharger.

In the above embodiment, the delivery flow rate of a pump can be controlled in a duty range of 50% or less. When the delivery flow rate is to be controlled in a duty range of 50% or more, a control method described below may be used.

It should be noted first that the time the fuel pump in automobiles needs to be operated in such a condition is when an engine load is large, as during acceleration or traveling up a slope. That is, the control of the delivery flow rate in the duty range of 50% or more is carried out when the engine consumes a large amount of fuel to get high output torques.

Also in this case, the actuator is given a drive signal once every two reciprocating motions of the plunger 2 to control the delivery flow rate. In this operation, however, of the two delivery strokes, one delivery stroke controls a delivery timing and the other delivery stroke delivers the full amount of fuel to control the average delivery flow rate of the two delivery strokes. That is, a drive signal is applied to the actuator the retraction delay time t1 before the timing at which the delivery is to be begun. This causes the rod 91 to be pulled up or retracted to allow the suction valve 5 to close so that the fuel can be compressed and delivered at a timing when the delivery is to be begun. After this, until the next delivery stroke begins, the rod 91 is held and prevented from falling down or projecting. For this purpose, the drive signal needs to be kept issued from at least the pull-down delay time t2 before the beginning of the next delivery stroke. With the rod 91 remaining retracted or pulled up at the beginning of the next delivery stroke, the suction valve 5 is automatically closed by the liquid pressure and the force of its spring and the fuel in the pressurizing chamber 12 is pressurized. As the pressure in the pressurizing chamber becomes high, a high back pressure acts on the suction valve preventing the suction valve from being pushed open even when the rod 91 falls down or projects. As a result, the suction valve is closed at the beginning of the next delivery stroke and the amount of fuel equal to a volume displaced by the plunger 2 is delivered. The timing at which to start applying a drive signal to the actuator 8 and the width of the drive signal are calculated by the controller 57.

When, for example, a desired duty of the high-pressure fuel pump is 75%, it is possible to obtain an average duty of 75% in two delivery strokes by delivering 50% of the duty in one delivery stroke and 100% in the other delivery stroke. In the stroke that performs a 50% delivery, the controller 57 sends a drive signal to the actuator 8 the retraction delay time t1 before the timing at which the plunger finishes the 50% compression stroke, and continues to send the drive signal up to a timing the pull-down delay time t2 before the next delivery stroke begins, in order to hold the rod 91 from falling down until the next delivery stroke begins.

Because controlling the delivery flow rate in this manner can cut off the drive signal before the 100% delivery stroke begins, the interval up to a point in time when the next drive signal is issued becomes longer. This makes it possible to supply a required amount of fuel to an engine running at high speed without increasing the response speed of the actuator even when the reciprocating cycle of the plunger is short. Further, a cam with more lobes may be used in supplying fuel to an engine with a greater displacement, as described above.

Figure 3:
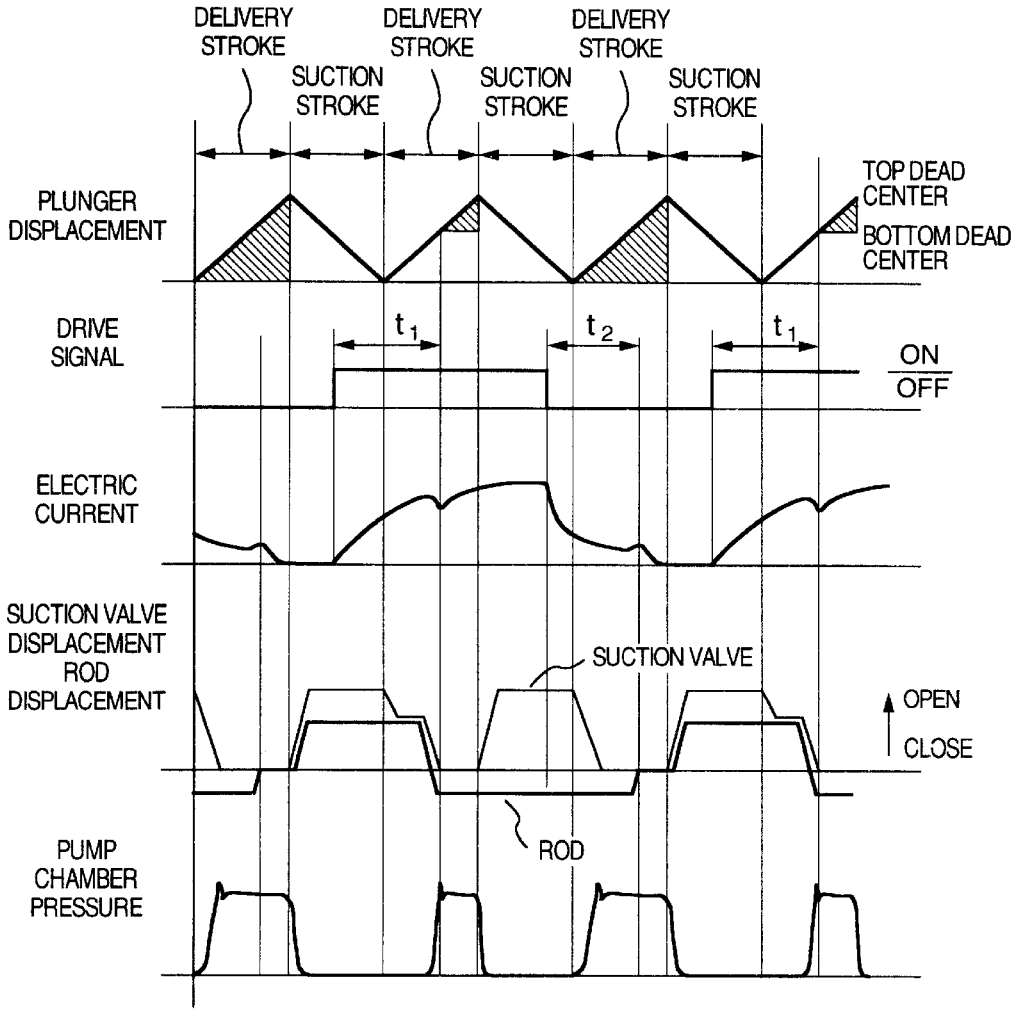
FIG. 3 is a timing diagram showing an example control of the high-pressure fuel pump of the present invention.

The delivery flow rate can be controlled in a duty range of between 0% and 100% by performing different controls in two separate cases, i.e., using the control method of FIG. 2 when the required duty is 50% or less and the control method of FIG. 3 when the required duty is 50% or more.

In this embodiment, because the suction valve 5 and the actuator 8 are separate members and the suction valve 5 is automatically opened, the control methods of FIG. 2 and FIG. 3 can be used. In a construction where the suction valve 5 and the actuator 8 are operated as one piece, because the suction valve 5 is closed while the actuator 8 is driven whether in the suction or delivery stroke, the control method of FIG. 3 which automatically opens or closes the suction valve 5 to deliver fuel in an amount equal to a volume displaced by one reciprocating motion of the plunger cannot be implemented. Although the control method of FIG. 2 can be implemented in a construction where the suction valve and the actuator are formed integral, the method of this embodiment is desirable in realizing a flow rate control in a wider range.

While in this embodiment a pull-type actuator has been described which, when applied a drive signal, pulls up or retracts the rod 91, it is also possible to use a push-type actuator that, when applied a drive signal, pushes down or projects the rod 91. In that case, the ON/OFF of the drive signal needs to be reversed and the delivery flow rate control similar to those of FIG. 2 and FIG. 3 can be applied.

Although this control method can also be applied when the engine revolution speed is low, it does not have to be used when the reciprocating cycle of the plunger is sufficiently longer than the response delay time of the displacement control mechanism and an appropriate control method of the fuel supply apparatus may be selected according to the revolution speed of the engine.

Figure 4:
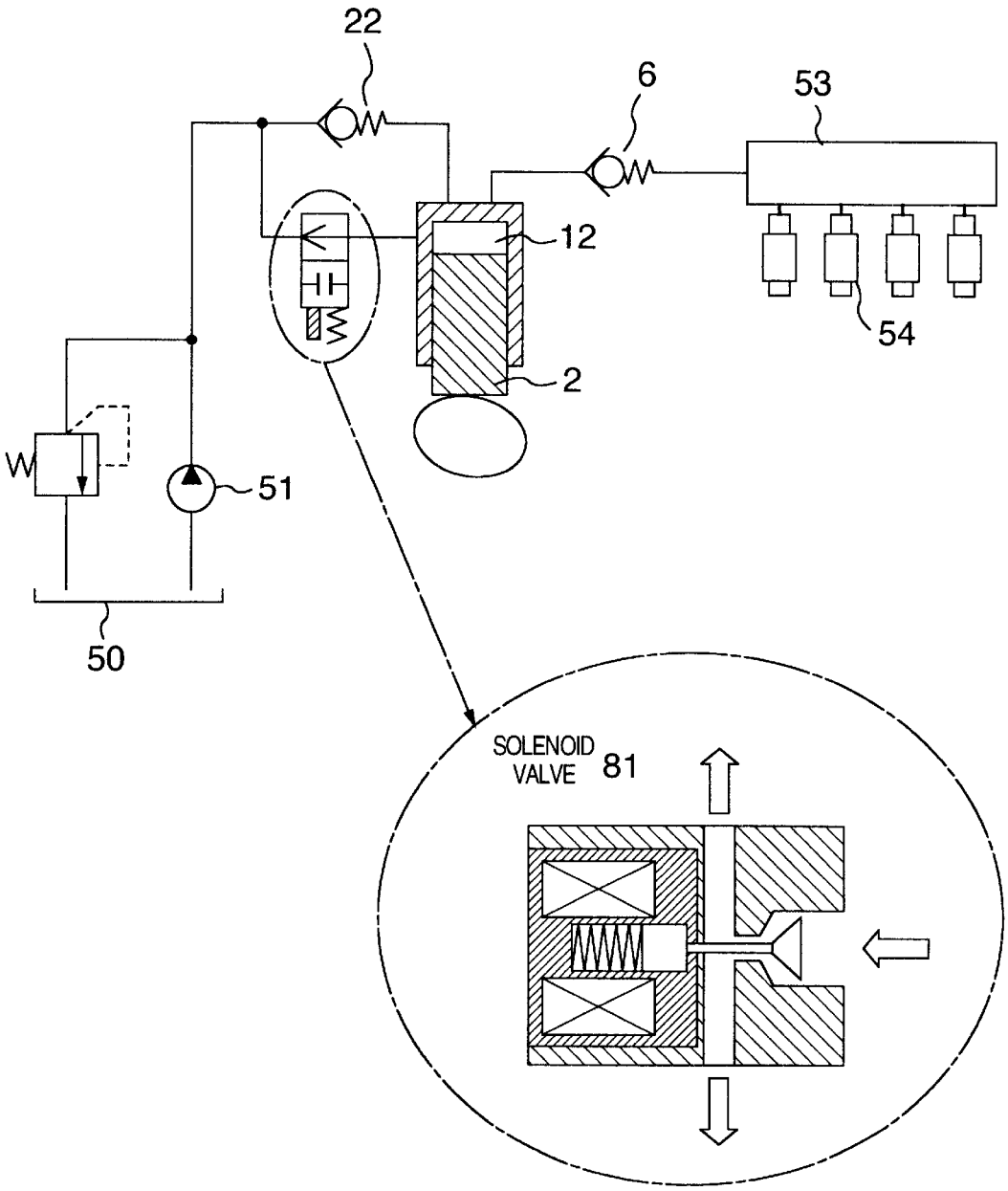
FIG. 4 is a schematic diagram showing a construction of a high-pressure fuel pump incorporating another embodiment of the present invention.
Figure 5:
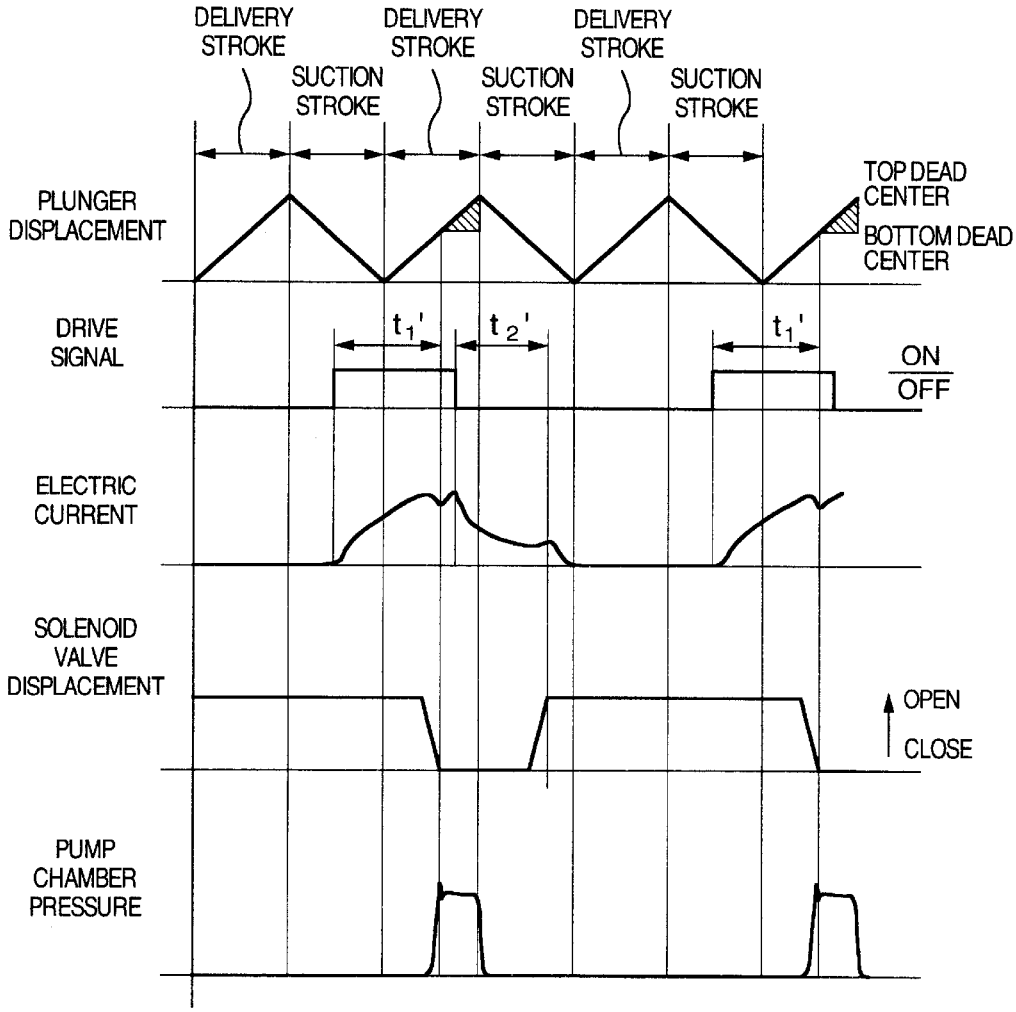
FIG. 5 is a timing diagram showing an example control in a system of FIG. 4.
Figure 6:
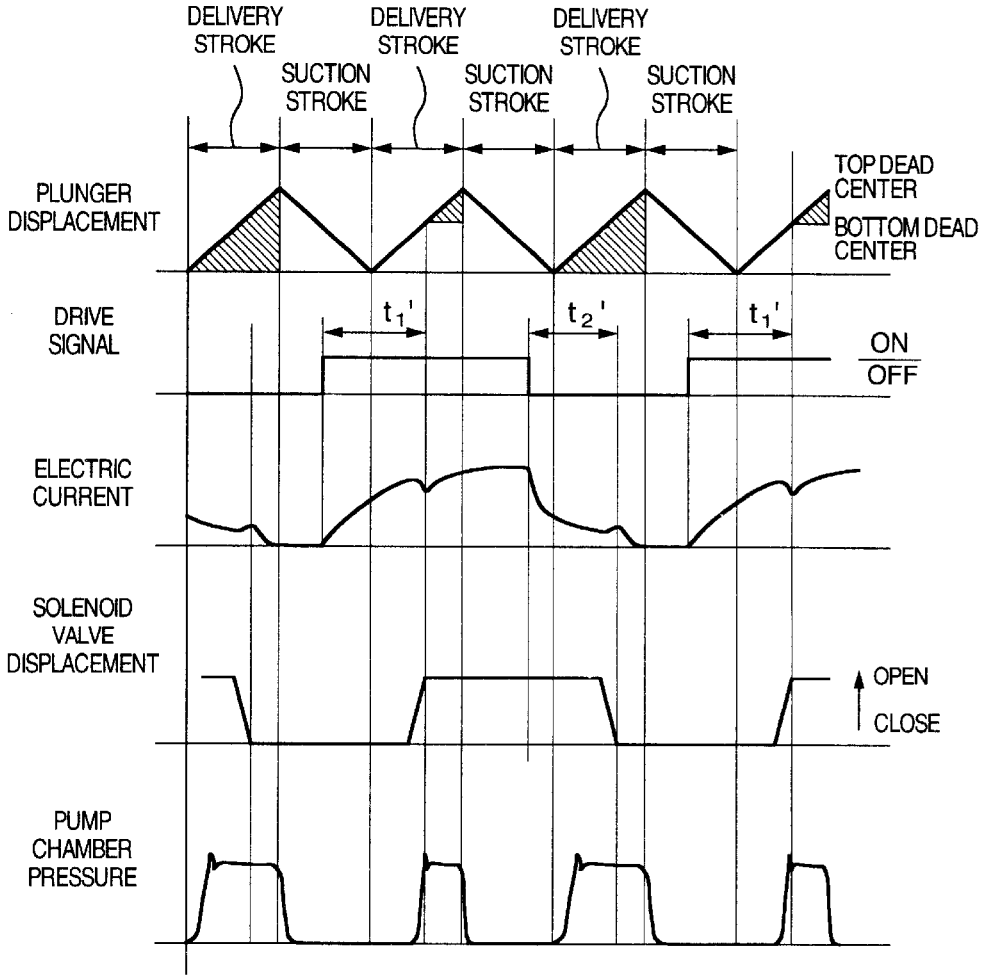
FIG. 6 is a timing diagram showing an example control in the system of FIG. 4.

FIG. 5 and FIG. 6 are timing diagrams when the control method of this invention is applied to a high-pressure fuel pump of another construction shown in FIG. 4.

In FIG. 4, the pump has a first passage for supplying fuel through a suction valve 22 into a pressurizing chamber, a second passage for releasing the fuel in the pressurizing chamber to a low-pressure path (upstream of the suction valve 22), and a solenoid valve 81 for opening and closing the second passage. The suction valve 22 automatically opens and closes and the solenoid valve 81 closes when applied with a drive signal. Fuel is pumped by a low-pressure pump 51 from a tank 50 to the pressurizing chamber through the suction valve 22. During the delivery stroke, when the solenoid valve 81 is not applied a drive signal, the fuel in the pressurizing chamber is returned to the low-pressure path without being pressurized. When the solenoid valve 81 is applied a drive signal in the middle of the delivery stroke, the second passage to the low-pressure path is closed, with the result that the pressure in the pressurizing chamber increases, delivering fuel from the high-pressure fuel pump. A high-pressure fuel pump of such a construction can apply the control method of this invention, as with the high-pressure fuel pump of FIG. 1.

FIG. 5 shows an example of control timing when fuel is delivered at a duty of 50% or less. In FIG. 5, there is a time delay from the application of a drive signal to the operation of the solenoid valve, as with the actuator of FIG. 1. The time taken from when a drive signal is applied until the solenoid valve closes is referred to as a close delay time t1'; and the time taken from when the drive signal is cut off until the solenoid valve opens is referred to as an open delay time t2'. The delivery flow rate of every two delivery strokes is controlled by not delivering fuel in one out of every two delivery strokes and by controlling the delivery flow rate in the other. This produces a margin between a point in time which is the open delay time t2' after the drive signal to the solenoid valve 81 has been cut off and a point in time when the next drive signal is to be issued. Rather than delivering small amounts of fuel in two delivery operations, supplying fuel in one delivery operation can produce a wider time interval between the successive drive signals. Further, because the number of times that the solenoid valve 81 is energized decreases, the power consumption and the amount of heat generated also decrease.

FIG. 6 shows an example of control timing when fuel is delivered at a duty of 50% or more. In FIG. 6, the solenoid valve 81 is applied a drive signal once every two reciprocating motions of the plunger as in the previous example. The delivery flow rate of every two delivery strokes is controlled by controlling the delivery timing in one out of every two delivery strokes and delivering the full amount of fuel in the other delivery stroke. The drive signal is issued the close delay time t1' before the delivery is to begin, and is kept issued to hold the solenoid valve open until the next delivery stroke begins. Fuel is supplied through the suction valve 22 to the pressurizing chamber and, at the beginning of the next delivery stroke, the suction valve 22 is automatically closed and the fuel delivered. In the second delivery stroke with a full duty, the solenoid valve needs to be kept closed. If the valve disc of the solenoid valve is of an externally open type, as shown in FIG. 4, when the pressure in the pressurizing chamber becomes high, a back pressure acts on the valve which therefore does not open even when the drive signal is cut off. Hence, the drive signal needs only to continue to be applied up to a point in time of the open delay time t2' before the next delivery stroke begins, as in the previous embodiment. Because this method increases a time margin present before the next drive signal is issued, as in the example of FIG. 3, it is possible to control the delivery flow rate even when the reciprocating cycle of the plunger is short.

Although the fuel supply apparatus constructed as shown in FIG. 4 can adopt this control method also when the engine revolution speed is low, there is no need to use this method when the reciprocating cycle of the plunger is sufficiently longer than the response delay time of the displacement control mechanism and an appropriate control method for the fuel supply apparatus may be selected according to the revolution speed of the engine.

While the timing diagrams of FIG. 5 and FIG. 6 are those for the apparatus using a normally open type solenoid valve, the control method of this invention can also be implemented in an apparatus using a normally closed type solenoid valve by reversing the ON/OFF of the drive signal.

As described above, according to the invention it is possible to realize a high-pressure fuel pump that can perform the delivery flow rate control without increasing the responsiveness of the variable displacement mechanism even when the reciprocating cycle of the plunger is short. Furthermore, when the duty is small, the driving time for the variable displacement mechanism is short, reducing the power consumption and heat generation.

In actual automobiles, it is possible to supply a required amount of fuel in a high engine revolution range. Further, when the number of cam lobes is increased to increase the number of reciprocating motions of the plunger and therefore the maximum amount of fuel supplied, a variable displacement control can be realized without increasing the responsiveness of the actuator. This enables a sufficient amount of fuel to be supplied to large displacement engines and turbocharged engines that consume large amounts of fuel.

Because one kind of high-pressure fuel pump can be commonly used for a wide range of engines, from small-displacement engines to large-displacement engines, by simply changing the number of cam lobes, the manufacturing cost can be lowered by mass production. The procurement and management of parts can also be simplified.

According to the invention, a high-pressure fuel pump can be realized which can perform a delivery flow rate control without increasing the responsiveness of the variable displacement mechanism even when the reciprocating cycle of the plunger is short.

What is claimed is:

1. A fuel supply apparatus comprising:

a fuel pump having a pump chamber, a pump plunger reciprocating in the pump chamber, a suction valve connected to a suction side of the pump chamber, a delivery valve connected to a delivery side of the pump chamber, and an actuator opening and closing the suction valve; and a controller regulating, through control of the actuator, a pressure of fuel to be supplied to an injector that is substantially constant, said controller controlling the actuator to open the suction valve only once and close the suction valve only once during at least two reciprocating motions of the plunger, thereby varying a delivery flow rate of the fuel pump.

2. A fuel supply apparatus according to claim 1, wherein in one of two reciprocating motions of the plunger, the suction valve is kept open to prevent delivery of fuel and, in the other reciprocating motion, timing of closing of the suction valve is controlled, thereby controlling the delivery flow rate from the fuel pump.

3. A fuel supply apparatus according to claim 1, wherein in one of two reciprocating motions of the plunger, timing of closing of the suction valve is controlled and, in a delivery stroke of the other reciprocating motion, the actuator is held to close the suction valve, thereby controlling the delivery flow rate from the fuel pump.

4. A fuel supply apparatus according to claim 1, wherein said controller calculates a necessary fuel supply rate to the injector such that (i) when the fuel supply rate is at 50% or less of a maximum delivery flow rate of the fuel pump, in one of two reciprocating motions of the plunger, the suction valve is kept open to prevent delivery of fuel and, in the other reciprocating motion, timing of closing of the suction valve is controlled to control the delivery flow rate of the fuel pump, and (ii) when the fuel supply rate is at 50% or more of the maximum delivery flow rate of the fuel pump, in one of two reciprocating motions of the plunger, timing of closing of the suction valve is controlled and, in a delivery stroke of the other reciprocating motion, the actuator is held to close the suction valve to control the delivery flow rate of the fuel pump.

5. A fuel supply apparatus according to claim 1, wherein opening of the suction valve only once and closing of the suction valve only once during at least two reciprocating motions of the plunger are performed cyclically.

6. A fuel supply apparatus according to claim 1, wherein in a first one of two reciprocating motions of the plunger, timing of closing of the suction valve is controlled and, in a delivery stroke of the other reciprocating motion following the first reciprocating motion, the actuator is held to close the suction valve continuously to a previous delivery stroke to control the delivery flow rate from the fuel pump.

7. A fuel supply apparatus according to claim 1, wherein said controller calculates a necessary fuel supply rate to the injector such that (i) when the fuel supply rate is at 50% or less of a maximum delivery flow rate of the fuel pump, in one of two reciprocating motions of the plunger, said suction valve is kept open to prevent delivery of fuel and, in the other reciprocating motion, timing of closing of the suction valve is controlled to control the delivery flow rate of the fuel pump, and (ii) when the fuel supply rate is at 50% or more of the maximum delivery flow rate of the fuel pump, in a first one of two reciprocating motions of the plunger, timing of closing the suction valve is controlled and, in a delivery stroke of the other reciprocating motion following the first reciprocating motion, the actuator is held to close the suction valve continuously to a previous delivery stroke to control the delivery flow rate of the fuel pump.

8. A fuel supply apparatus according to claim 1, wherein a sum of a retraction delay time of said suction valve and a pull-down delay time thereof is longer than a reciprocating cycle of the plunger.

9. A fuel supply apparatus according to claim 1, wherein said fuel pump has a common rail connected to a delivery side of the fuel pump, to which a plurality of injectors are connected.

10. A fuel supply apparatus comprising:

a fuel pump having a pump chamber, a pump plunger reciprocating in the pump chamber, a suction valve connected to a suction side of the pump chamber, a delivery valve connected to a delivery side of the pump chamber, and an actuator opening and closing the suction valve; and a controller regulating, through control of the actuator, a pressure of fuel to be supplied to an injector that is substantially constant, the controller controlling timing of closing of the suction valve in a delivery stroke of one of two reciprocating motions of the plunger, and keeping one of opening of the suction valve and closing of the suction valve in a delivery stroke of the other reciprocating motion to effect no control on a delivery flow rate of the fuel pump, thereby varying the flow rate of fuel delivered from the fuel pump in two delivery strokes.

11. A fuel supply apparatus according to claim 10, wherein a sum of a retraction delay time of said suction valve and a pull-down delay time thereof is longer than a reciprocating cycle of the plunger.

12. A fuel supply apparatus according to claim 10, wherein said fuel pump has a common rail connected to a delivery side of the fuel pump, to which a plurality of injectors are connected.

13. A method of controlling a fuel supply apparatus including a fuel pump having a pump chamber, a pump plunger reciprocating in the pump chamber, a suction valve connected to a suction side of the pump chamber, a delivery valve connected to a delivery side of the pump chamber, and an actuator opening and closing the suction valve, the method comprising controlling of the actuator to open the suction valve only once and closing the suction valve only once during at least two reciprocating motions of the plunger, thereby varying a delivery flow rate of the fuel pump.

14. A method of controlling a fuel supply apparatus including a fuel pump having a pump chamber, a pump plunger reciprocating in the pump chamber, a suction valve connected to a suction side of the pump chamber, a delivery valve connected to a delivery side of the pump chamber, and an actuator opening and closing the suction valve, the method comprising calculating a necessary fuel supply rate to the injector, such that (i) when the fuel supply rate is at 50% or less of a maximum delivery flow rate of the fuel pump, in one of two reciprocating motions of the plunger, the suction valve is kept open to prevent delivery of fuel and, in the other reciprocating motion, controlling timing of closing of the suction valve to control the delivery flow rate of the fuel pump, and (ii) when the fuel supply rate is at 50% or more of the maximum delivery flow rate of the fuel pump, in one of two reciprocating motions of the plunger, controlling timing of closing of the suction valve and, in a delivery stroke of the other reciprocating motion, holding the actuator to close the suction valve to control the delivery flow rate of the fuel pump.

* * * * *